US005078233A

United States Patent [19]

Oetting et al.

[11] Patent Number: 5,078,233

[45] Date of Patent: Jan. 7, 1992

[54] OIL SUPPLY SYSTEM FOR MACHINES SUCH AS INTERNAL COMBUSTION ENGINES

[75] Inventors: Hermann Oetting, Braunschweig; Dieter Voigt, Wolfsburg, both of Fed. Rep. of Germany

[73] Assignee: Volkswagen AG, Fed. Rep. of Germany

[21] Appl. No.: 654,273

[22] Filed: Feb. 12, 1991

[30] Foreign Application Priority Data

Feb. 28, 1990 [DE] Fed. Rep. of Germany ..... 4006177
Nov. 28, 1990 [DE] Fed. Rep. of Germany ..... 4037803

[51] Int. Cl.[5] ..... F01M 1/04

[52] U.S. Cl. ..... 184/6.5; 184/103.1; 184/105.1; 123/196 R

[58] Field of Search ..... 184/6.5, 103.1, 103.2, 184/55.1, 58, 59, 76, 105.1; 123/196 R, 196 S, 572, 573

[56] References Cited

U.S. PATENT DOCUMENTS 1,125,238 1/1915 Wilburn ..... 184/58
2,564,230 8/1951 Pitney ..... 184/103.1
2,615,442 10/1952 Berry ..... 184/103.1
2,689,628 9/1954 Schott ..... 184/103.2
2,856,026 10/1958 Wahmann ..... 184/105.1
2,946,328 7/1960 Mettetal, Jr. ..... 184/103.1
4,069,895 1/1978 Beach et al. ..... 184/106

FOREIGN PATENT DOCUMENTS 3711792 10/1987 Fed. Rep. of Germany .
0940220 12/1948 France ..... 184/103.1
0078722 3/1990 Japan ..... 184/6.5

*Primary Examiner*—Ira S. Lazarus
*Assistant Examiner*—Alan B. Cariaso
*Attorney, Agent, or Firm*—Brumbaugh, Graves, Donohue & Raymond

[57] ABSTRACT

In the embodiments disclosed in the specification, an oil supply system for an internal combustion engine having an oil pan includes an oil reservoir located above the oil pan and an ascending line between the oil pan and the reservoir for delivering excess oil from the oil pan into the oil reservoir using blow-by gases produced in the engine and a flow path for resupplying used oil from the oil reservoir into the oil pan. The oil to be delivered to the individual parts of the engine for cooling and lubricating is supplied from the oil pan by a pumped delivery line and the amount of oil maintained in the oil pan is as small as possible.

16 Claims, 2 Drawing Sheets

OIL SUPPLY SYSTEM FOR MACHINES SUCH AS INTERNAL COMBUSTION ENGINES

BACKGROUND OF THE INVENTION

This invention relates to oil supply systems for supplying lubricating and/or cooling oil to machines such as internal combustion engines.

In German Offenlegungsschrift No. 3 711 792, an oil supply for an internal combustion engine has an oil delivery line which descends from an elevated oil reservoir to the engine parts such as bearings that are to be supplied with oil. In order to transfer the entire amount of oil necessary for lubrication or cooling of the engine from the oil pan through an ascending line into the elevated oil reservoir, the ascending line is designed so that a sufficiently high pressure in the area of the oil pan will assure the required transfer. This arrangement has the fundamental advantage that it eliminates the need for an oil pump for conveying the oil from the oil pan into the oil reservoir and a very small volume of oil can be maintained in the oil pan because of the presence of the oil reservoir within or on the side of the engine. Therefore, the oil level in the oil pan can be very shallow, but this presupposes that the proper pressure conditions are established and thus that the oil pan has a virtually airtight seal with respect to the atmosphere. As a rule, however, the oil pan communicates with bearings for moving parts, such as crankshaft bearings, which are not airtight and which are exposed to atmospheric pressure on the other side. Furthermore, it is often of interest to be able to monitor the oil level in the oil pan with a dipstick. The opening for such a dipstick permits leakage of pressure from the oil pan.

A device for automatically replenishing the oil in the crankcase of an internal combustion engine is disclosed in German Patent No. 2 940 235, wherein an oil delivery line and an oil pump are connected to the intake side of the oil volume in the oil pan and an elevated refill tank that is sealed with respect to the atmosphere resupplies used oil to the oil pan through a valve arrangement. However, no arrangement for transporting oil to the refill tank is provided in this device, nor does that patent disclose any arrangement for avoiding the use of an additional pump by utilizing certain pressure conditions in the refill tank and the oil pan area.

SUMMARY OF THE INVENTION

Accordingly, it is an object of the present invention to provide an oil supply system which overcomes the above-mentioned disadvantages of the prior art.

Another object of the invention is to provide an oil supply system having an elevated oil reservoir to which oil is delivered from an oil pan by a gas pressure difference while avoiding the problems resulting from gas pressure leakage.

A further object of the invention is to provide an oil supply system utilizing blow-by gases to convey the oil from the oil pan into an oil reservoir, while a constant, relatively low, oil level is maintained in the oil pan without requiring complete sealing of the oil pan space or the oil reservoir from the atmosphere.

These and other objects of the invention are attained by providing an oil supply system with an oil delivery line extending from an oil pan to oil-receiving parts of a machine, and an oil transfer line ascending from the oil pan to an elevated oil reservoir, the oil transfer line being provided with a gas inlet which is located above the level of the oil in the oil pan and with an oil inlet opening adjacent to the desired oil level in the oil pan, along with a flow restriction between the oil pan and the reservoir.

In the above-described prior art oil supply systems, the total amount of useful oil to be supplied to the machine parts through the ascending line from the oil pan must be conveyed by the blow-by gases, but with the supply system of the present invention, the transfer of oil is reduced to the volume of oil above the specified oil level in the oil pan. Conversely, the amount of oil transferred through the ascending line to the oil reservoir from the oil pan is only enough to compensate for the actual oil consumption. Therefore, it is possible to provide an oil level sensor, e.g., a pressure sensor, in the oil reservoir in order to supply a signal to an operator such as the driver of a motor vehicle equipped with this system whenever the oil level in the oil reservoir drops below a given minimum. This signal notifies the driver to add oil at the next filling station, for example. Thus, a minimum oil supply is always available in the oil reservoir for resupply to the oil pan.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
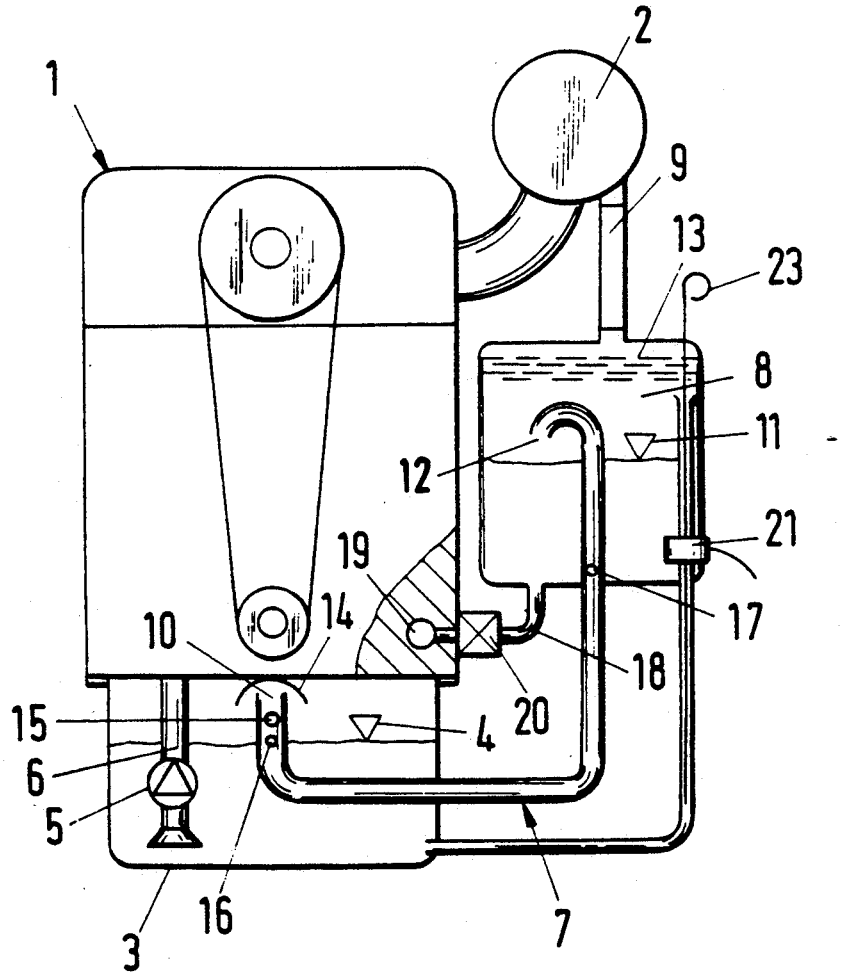
FIG. 1 is a schematic elevational view, partly in section, showing a representative embodiment of an oil supply system for a motor vehicle internal combustion engine arranged according to the invention.
Figure 2:
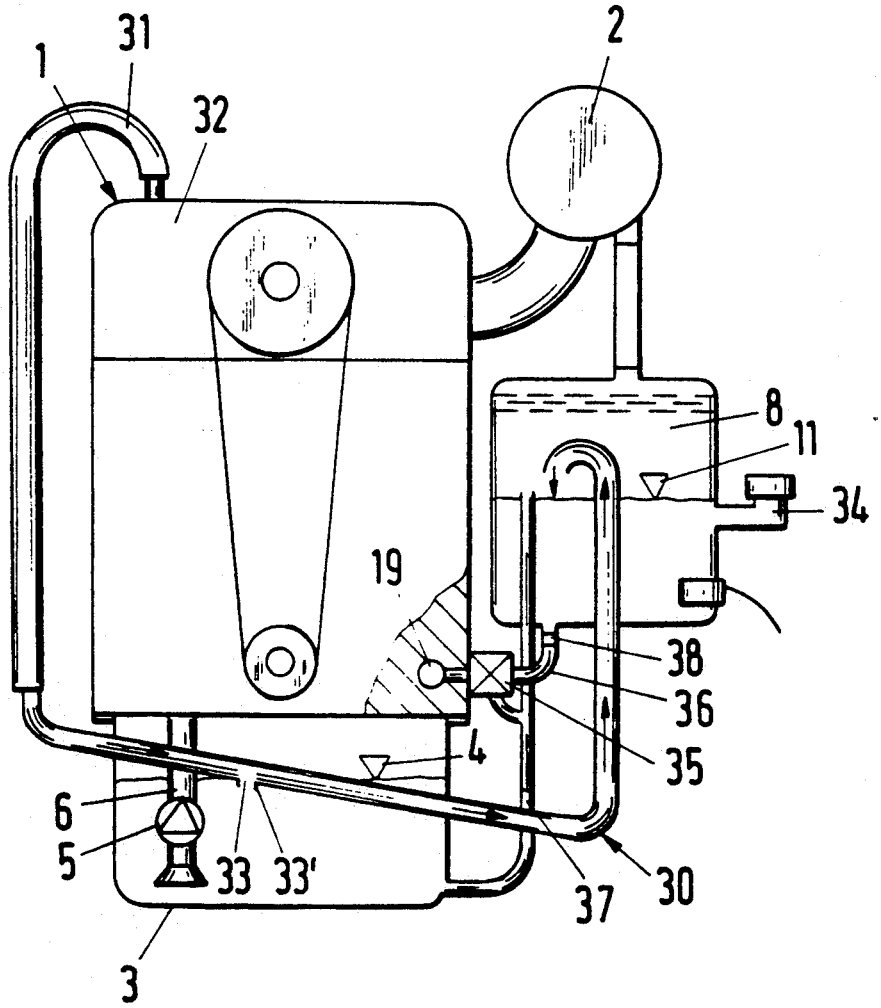
FIG. 2 is a schematic elevational view similar to that of FIG. 1, showing another typical embodiment of an oil supply system according to the invention.

In the embodiments shown in FIGS. 1 and 2, an internal combustion engine 1 having an intake manifold 2 and an oil pan 3 is provided with an oil supply system according to the invention. Further details of the design of the engine are not shown because the engine design is conventional and other details are irrelevant for a description of the present invention. The oil level 4 in the oil pan 3 is indicated in the conventional manner. An oil delivery line 6 which is equipped with an oil pump 5 extends from below the oil level 4 in the oil pan into the engine and carries oil from the pan through a pressure line system to the parts of the engine to be lubricated, especially the engine bearings, where it passes out of the oil line system. After fulfilling its lubricating and/or cooling function, the oil drips back into the oil pan 3.

In the embodiment shown in FIG. 1, an ascending line 7 extends from the oil pan region, i.e., the crankcase space above the oil level 4, to an elevated oil reservoir 8 and a hose 9 connects the reservoir to the intake manifold 2 of the engine to remove blow-by gases received by the reservoir from the crankcase. In the crankcase, the blow-by gases pass into the ascending line 7 through an inlet end 10 which is open to the crankcase gases and is always above the oil level 4. After emerging from an upper end 12 of the line 7, which is above the oil level 11 in the oil reservoir 8, the blow-by gases pass into the upper area of the oil reservoir 8 which is equipped with an oil trap 13 and from there they pass through the line 9 and the manifold 2 into the combustion chambers of the engine during operation. A hat-shaped hood 14 mounted above the open inlet end 10 of the ascending line 7 prevents entrainment of oil dripping down from the engine 1 into the oil pan 3. It would also be possible to bend the lower end 10 of the ascending line 7 downwardly so that the opening would point down toward the oil level 4 in the same manner shown at the upper end 12 of the ascending line which is within the oil reservoir 8. In that case, the hood 14 would not be necessary.

In the typical example shown in FIG. 1, two cross-bores 15 and 16 are positioned slightly above the normal oil level 4 in the lower end of the ascending line 7 within the crankcase. These cross-bores are dimensioned to provide a predetermined throttling effect on the flow of oil from the oil pan into the ascending line 7. As soon as the oil level 4 exceeds a selected value, oil passes through at least one of the cross-bores 15 and 16 into the ascending line and is entrained by the blow-by gases passing through the line in the direction of the oil reservoir 8, where such excess oil is stored.

Several possible ways for resupplying used oil from the reservoir to the oil pan 3 are indicated in FIG. 1. One possibility is to provide at least one cross-bore 17 in the part of the ascending line 7 that is inside the oil volume of the oil reservoir 8. In those operating conditions of the engine when little or no blow-by gas is produced, oil can be resupplied from the oil reservoir 8 to the oil pan 3 through the bore 17, which has a relatively small diameter, and the ascending line 7.

If the normal oil level in the oil pan 3 is exceeded by such backflow through the line 7, that level is restored by drainage through the cross-bores 15 and 16 when blow-by gases are generated.

Another possible way to convey oil from the reservoir 8 into the oil pan 3 is by way of a valve 20 in a connecting line 18 between the oil reservoir 8 and a pressure oil line 19 in the engine 1. The valve 20 is controlled by oil pressure so that it is open when the engine is not operating. In that condition, oil passes out of the oil reservoir 8 through the line 19 into the engine lubricating system from which it leaks back into the oil pan 3. A similar valve design is described, for example, in the above-cited German Patent No. 2 940 235.

Finally, an electrically controlled valve can also be provided in a connecting line (not shown) extending directly between the oil reservoir 8 and the engine 1 or the crankcase with the valve arranged to open in case more oil is needed in the oil pan 3.

A filling level sensor 21 in the oil reservoir 8 transmits a signal to the operator of the engine 1 indicating that oil should be added when the oil level in the oil reservoir 8 drops below a selected level. When the engine is started, the oil level in the oil reservoir is below the selected level for system reasons. Consequently, no add-oil signal should be sent before normal engine operating conditions have been established.

In starting the engine, the selected level in the oil pan may be exceeded because no blow-by gas is produced during idling and there is a drainage connection between the oil reservoir 8 and the oil pan 3. However, this condition is eliminated when the engine has been operated for a short time.

If desired, the oil reservoir 8 may be located inside the engine, for example, inside the oil pan space. Another arrangement is also indicated in FIG. 1 wherein an overflow line 22 having an oil measurement stick 23 extends between the oil reservoir 8 and the oil volume in the oil pan 3.

In the alternative embodiment shown in FIG. 2, the components designated by the numbers 1–6, 8 and 19 in connection with FIG. 1 are also illustrated in FIG. 2. In this case, however, an ascending line 30 has a blow-by gas inlet which is not inside the oil pan 3 since that requires an arrangement to prevent the undesired entrance of oil into the line. Instead, the blow-by gases enter the line through a tube 31 from a location on a cylinder head 32 of the engine 1 where the blow-by gases are present. From the tube 31, the ascending line 30 is inclined downwardly through the oil pan and is formed with an oil inlet opening 33 so that oil is conveyed by the blow-by gases from the oil pan in the direction of the arrow into the oil reservoir 8 when a selected oil level in the oil pan is exceeded. The opening 33 is surrounded by a downwardly extending tube 33' to prevent the admission of blow-by gases from the crankcase into the line 30. An oil filling connection 34 provided in the oil reservoir 8 at the level of the maximum allowed oil level assures that overfilling does not occur when adding oil to the system. If more oil is added to the connection 34, the maximum oil level 11 in the reservoir 8 is reached, and this oil cannot flow into the oil reservoir.

In this typical embodiment, a connection is established between the oil reservoir 8 and the oil pan 3 by two lines 36 and 37 and a valve 35 which is controlled by the oil pressure in the engine and the pressure line 19 either when the engine is running or when it is stopped. If the connection is open while the engine is running, a choke 38 may be provided in the line 36 which limits the flow through this line. Otherwise, the valve 35 is operated intermittently in order to limit the amount of oil flowing into the oil pan 3.

Thus, this invention provides an oil supply system having the advantages of prior art systems with an elevated oil reservoir and an oil transfer arrangement using blow-by gases from the engine but which limits the required oil transport from the oil pan into the oil reservoir to the amount that exceeds a selected level in the oil pan.

Although the invention has been described herein with reference to specific embodiments, many modifications and variations therein will readily occur to those skilled in the art. Accordingly, all such variations and modifications are included within the intended scope of the invention.

We claim:

1. An oil supply system for an engine comprising an oil pan to receive oil dripping from the engine, an oil reservoir located at a level above the oil pan, a pump-free ascending line for transferring oil from the oil pan to the oil reservoir by a pneumatic pressure difference, the oil pan communicating with the atmosphere only through the ascending line and the oil reservoir, the ascending line having an aperture in the oil reservoir above the oil level therein and having a cross-section such that oil from the oil pan is delivered through the ascending line into the oil reservoir by increased pressure in the oil pan resulting from admission of gases thereto during operation of the engine, and an oil delivery line rising from the oil pan and having a pump for supplying oil to the engine, the ascending line having an opening arranged always at a level above the oil level in the oil pan to receive gases at elevated pressure and being protected against admission of splashed oil or oil droplets from the engine, the ascending line having at least one aperture for the entry of oil arranged slightly above the normal oil level in the oil pan, and means providing a flow path for transferring oil from the oil reservoir to the oil pan.

2. An oil supply system according to claim 1 wherein the means providing a flow path includes a restricted opening in the ascending line below the oil level in the oil reservoir.

3. An oil supply system according to claim 1 wherein the means providing a flow path includes a leaky pressure line system in the engine and an oil pressure-actuated valve between the engine pressure line system and the oil reservoir that is opened only when the engine is stopped.

4. An oil supply system according to claim 1 wherein the means providing a flow path includes a connection between the oil pan and the oil reservoir having an electromagnetic valve.

5. An oil supply system according to claim 1 wherein the means providing a flow path includes a connection between the oil pan and the oil reservoir having a valve that opens the connection only when the engine is running or only when the engine is stopped.

6. An oil supply system according to claim 5 wherein the valve is actuated by oil pressure.

7. An oil supply system according to claim 5 wherein the valve is an electromagnetic valve.

8. An oil supply system according to claim 5 wherein the valve opens the connection when the engine is running and a flow limit is provided by a throttle in the flow path or by intermittent valve operation.

9. An oil supply system according to claim 1 wherein the ascending line receives gases at elevated pressure through an opening which is within the oil pan and above the oil level in the pan and faces downwardly.

10. An oil supply system according to claim 1 wherein the ascending line receives gases at elevated pressure through an opening which is within the oil pan and above the oil level in the pan and includes a hood.

11. An oil supply system according to claim 1 wherein the ascending line receives gases at elevated pressure from a part of the engine above the oil pan.

12. An oil supply system according to claim 11 wherein the ascending line extends through the oil pan and has an aperture therein which is protected against admission of blow-by gases by a dip tube.

13. An oil supply system according to claim 1 including an oil filling connection in the oil reservoir located at the maximum allowed oil level.

14. An oil supply system according to claim 1 including an oil level sensor in the oil reservoir arranged to provide a delayed oil deficiency signal.

15. An oil supply system according to claim 1 including an oil overflow line extending from the oil reservoir into the oil pan.

16. An oil supply system according to claim 15 wherein the overflow line includes an oil measurement stick.

* * * * *